US005649330A

United States Patent [19]

Lind

[11] Patent Number: 5,649,330

[45] Date of Patent: Jul. 22, 1997

[54] HEATED FLEXIBLE BATHING CONTAINER

[76] Inventor: Alan R. Lind, P.O. Box 1048, Penn Valley, Calif. 95946

[21] Appl. No.: 432,418

[22] Filed: Apr. 24, 1995

[51] Int. Cl.[6] ..... A47K 3/06

[52] U.S. Cl. ..... 4/545; 4/584; 4/585; 126/368

[58] Field of Search ..... 4/507, 508, 509, 4/510, 493, 545, 584, 585; 126/345, 367, 368

[56] References Cited

U.S. PATENT DOCUMENTS

| | | | |
|---|---|---|---|
| X2,005 | 10/1813 | Harrington | 4/545 |
| 135,005 | 1/1873 | Nott | 126/345 |
| 248,790 | 10/1881 | Prewitt | 4/545 |
| 251,227 | 12/1881 | Heinrich | 4/545 |
| 414,800 | 11/1889 | Edminster | 126/368 X |
| 1,450,444 | 4/1923 | McGuire | 4/545 |
| 1,753,427 | 4/1930 | Phillips | 4/507 |
| 2,739,939 | 3/1956 | Leslie | 4/509 X |
| 4,443,900 | 4/1984 | Remeyer | 4/507 X |
| 4,455,997 | 6/1984 | Evans et al. | 4/545 X |
| 5,283,915 | 2/1994 | Idland et al. | 4/506 X |
| 5,408,707 | 4/1995 | Wilson | 4/585 X |

FOREIGN PATENT DOCUMENTS

| | | | |
|---|---|---|---|
| 0745564 | 5/1933 | France | 4/545 |
| 9107139 | 6/1984 | Japan | 4/545 |

*Primary Examiner*—Robert M. Fetsuga

[57] ABSTRACT

A self-heating outdoor bathtub to better simulate natural hot spring pools. Allows use of major components salvaged from discarded water heaters. Inconspicuous appearance, low value, and durability, eases concerns of theft or vandalism. A water heating unit and a flexible tarp, serving as a bathing container, joined by an open water passage between the two. The heating unit supplying heat from below.

9 Claims, 2 Drawing Sheets

HEATED FLEXIBLE BATHING CONTAINER

FIELD OF INVENTION

One of mankind's earliest pleasures was undoubtedly that of bathing and soaking in the warm-water pools of primitive hot springs; my invention relates to the age-old quest for an artificial hot spring, and more specifically, to a self heating, outdoor bathtub, or the like.

DISCUSSION OF PRIOR ART

Bathtubs heated by direct water-contact with a furnace located at one end of a tub was an early concept, leading eventually to development of the family spa, or hot-tub. Although the hot-tub has had tremendous commercial success, natural hot spring locations are as crowded as ever! Even hot-tub owners seem willing to drive any distance to get to the springs. But it is probably esthetic qualities, like green forests, great sunsets, and wildlife, rather than just the hot water, that is often the attraction now.

Heretofore, those qualities have, for the most part, been left unaddressed, if not unrecognized. There are many nice locations that would, with the addition of a hot-tub, rival any hot spring. But, as a practical matter, hot-tub owners are restricted to their back yards for a location because an expensive hot-tub cannot be left out in the countryside, unprotected from theft or vandalism.

OBJECTS OF THE INVENTION

Accordingly one object of my invention is to provide a heated out-door bath that may be set up on a temporary basis, using a plastic tarp as a means of containing the bath water. This foldable bathtub being attached to the heating unit with no danger of burning or melting the tarp.

ADVANTAGES OF THE INVENTION

The heated bath of my invention makes an important advance in the long felt desire to duplicate, in a heated bath, the many pleasures associated with natural hot springs, by allowing greater choice of locations. These choices being based on the natural beauty and other amenities of specific locations, rather than on concerns for the security of the equipment used.

A further advantage is the near-zero manufacturing cost afforded by my design, in which major components can be salvaged from discarded water heaters. Other substantial savings are inherent in the removal of these unwanted water heaters from the waste disposal system.

Yet a further advantage lies in my portable unit being suitable for use on public lands, where permanent structures are prohibited.

Still further objects and advantages will become apparent from a consideration of the ensuing description and drawings.

DRAWING FIGURES

Figure 1:
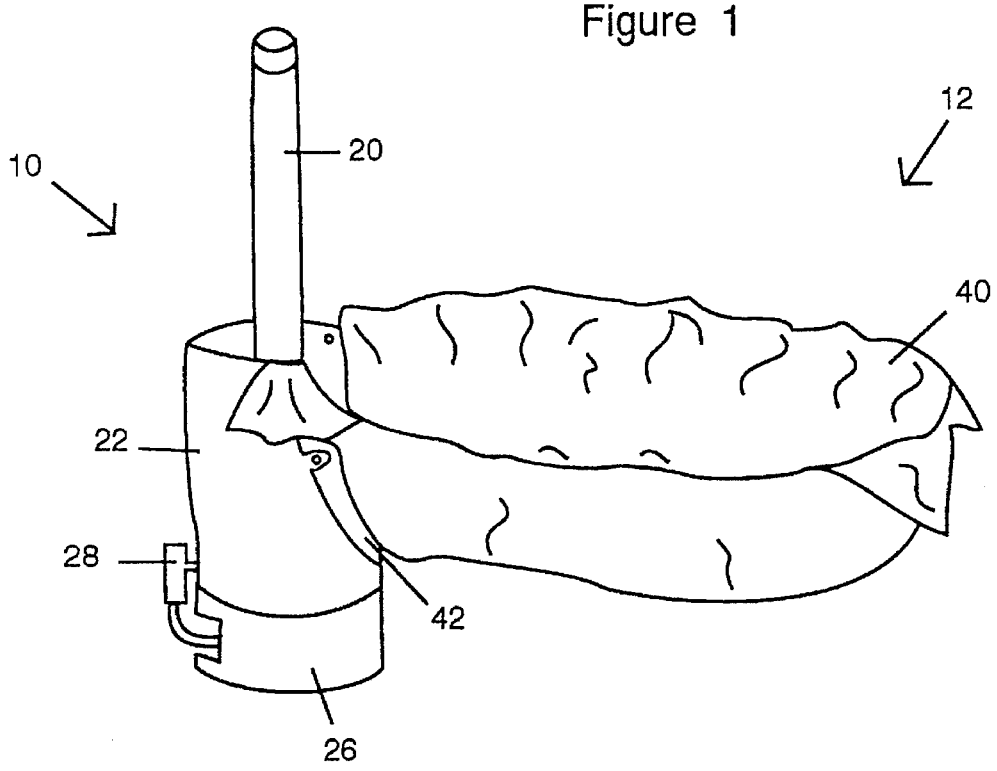
FIG. 1 shows a perspective view of my heated flexible bathing container.

| Reference Numerals used in Drawings | |
|---|---|
| 10 | Water Heating Unit |
| 12 | Bathtub Unit |
| 16 | Water Passage |
| 20 | Chimney |
| 22 | Outer Shell |
| 24 | Water Space |
| 26 | Cylindrical Firebox |
| 28 | Burner Control Unit |
| 30 | Drain hole |
| 32 | Drain Plug |
| 34 | Threaded Hole |
| 36 | U-shaped Cutout |
| 38 | Firebox Cutout |
| 40 | Flexible Tarp |
| 42 | Compression Plate |
| 44 | Threaded Studs |
| 46 | Alignment Hole |
| 48 | Alignment Slots |

DESCRIPTION OF HEATING UNIT

In the drawings, details of one embodiment of my self-heating bathtub is shown. It will be noticed (FIG. 1) that a water heating unit (10), and a bathtub unit (12) providing a means of containing bath water, and preferably is connected by an open water passage (16), in a water tight manner.

Figure 4:
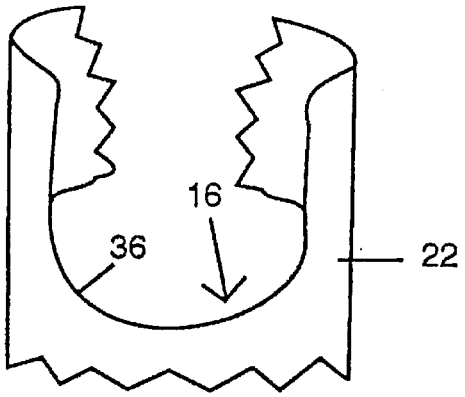
FIG. 4 shows a close up view of the cutout, or water passage, between the heater section and the tub section.
Figure 5:
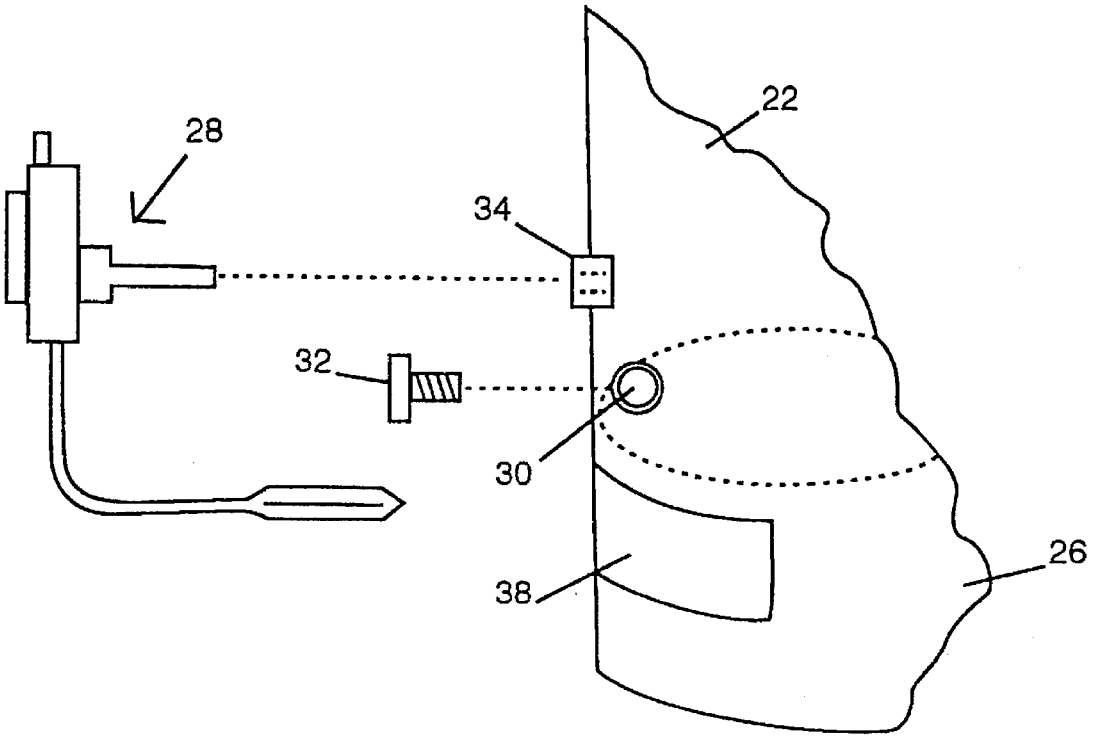
FIG. 5 Shows the conventional burner control unit with attached burner, thermostat, and pilot light.

The heating unit (10) has an inner cylindrical chimney (20), which is somewhat taller than a surrounding outer shell (22), with a water space, and specifically, an open top, or uncovered, a water space (24) between the two. U-shaped cutout (36) below the top edge of the outer shell (22) forms the opening for the water passage (16) (FIG. 4). The lower end of the outer shell (22) forms the wall for the cylindrical compartment, or firebox (26), directly below the water space (24), the overhead portion of which supports, and extends into the lower end of the chimney (20). A threaded drain hole (30) (FIG. 5), near the bottom of the water space (24), penetrates the outer shell (22), and holds a threaded drain plug (32) in place. A second threaded hole (34) placed slightly higher, but substantially in the same location as the first, accepts as a means of supplying heat the threaded fitting of a conventional water heater burner control & burner unit (28), above a cutout (38), serving as a means of accessing the firebox (26), so that the burner and pilot light portion of the burner control unit (28) passes through the cutout (38) to be supported in operational position below the chimney (20). The burner control unit (28) being connected to an outside gas supply.

Operation

With the gas supply connected to the burner & burner control unit (28), and the drain plug (32) installed in the drain hole (30), the bathtub unit (12), and Water heating unit (10), are simultaneously filled with water, from the most convenient outside source, to the desired depth for bathing. After lighting the pilot light, the burner control (28) is set to the desired water temperature. The burner portion of the burner control unit (28) is ignited to begin the heating process. The flames play against the upper interior of the firebox (26), the unburned gases and fumes escaping into the atmosphere via the chimney (20). At the same time, heat is radiated through the overhead portion of the firebox (26), and the sides of the chimney (20), into the water space (24), thereby heating the water. As the water heats, it rises, spreading-out into the adjoining bathtub unit (12). Colder water near the bottom of the bathtub (12) flows back through the water passage (16), to replace the water in the water heating unit (10). When the water reaches the desired temperature the thermostat portion of the burner control unit (28) cuts off the burner flame, and the bath is ready for use. The burner control unit (28) will re-fire the burner intermittently to maintain the water temperature within the desirable range. After the bath, the water may be drained by removing the drain plug (32). Where the possibility of vandalism warrants, the burner & burner control unit (28), can be taken apart, and unscrewed from the threaded hole (34). It can then be either hidden nearby, or removed with the rest of the gas supply equipment. Alternatively, the gas burner can be eliminated entirely by simply building a wood fire inside the cylindrical firebox (26).

Source of Material

It is no coincidence that certain gas water heaters contain all of the elements of my heating unit. Such water heaters are frequently discarded when leaks develop in the water tank. Repairing such leaks is not feasible, because there is no access to the damaged area inside the tank. Disposal of these water heaters is often an added expense to homeowners, or plumbing shops, who would gladly part with them, at little or no charge.

The open-top construction of the heating units (10) provides easy access to the interior of the tank, so that leak repairs can. be easily carried out, using well known welding techniques. This allows that, where the structural parts of a water heater correspond with the structure of the invention, that those parts should be salvaged and refurbished for re-use as a ready made heating unit, using well known metal-cutting and welding techniques.

Description of Tarp Attachment

Figure 2:
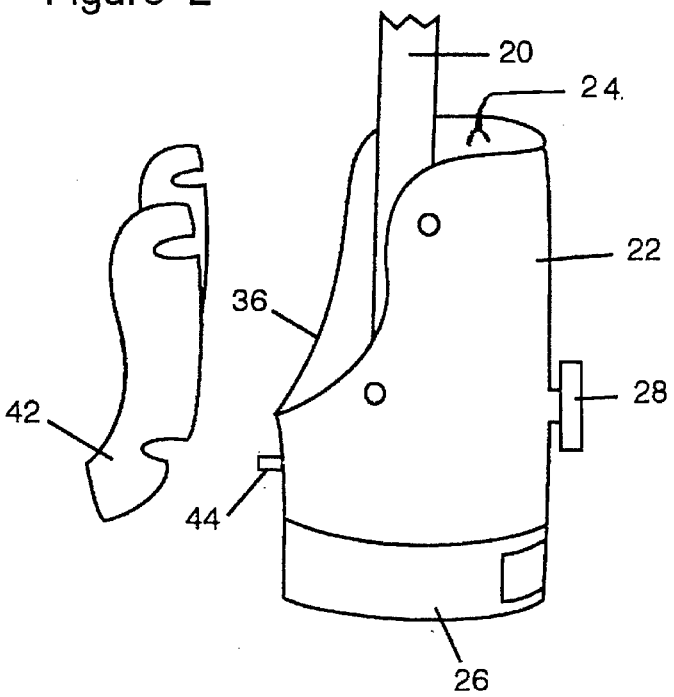
FIG. 2 shows the tarp clamping mechanism with the tarp removed.
Figure 3:
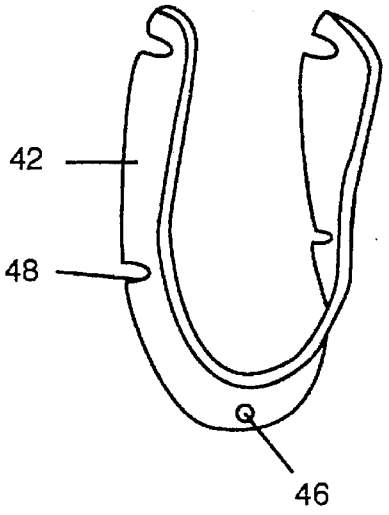
FIG. 3 shows a close up view of the compression plate used in the tarp connection.

A flexible tarp (40), or the like, (FIG. 1) is employed as a means of containing the bath water, and is attached to a u-shaped cutout (36) (FIG. 2) in the heating unit (10), by a clamping means, wherein the edge of the tarp (40) is compressed between the outside surface of the outer shell (22) near the cutout (36), and the compression plate (42) (FIGS. 2 and 3), in a vice-like fashion. A predetermined number of threaded studs (44) is spaced around the cutout (36) with one such threaded stud being located substantially at the lowest point on the cutout (36). The compression plate (42) (FIG. 3) features an alignment hole (46) in a matching location, a set of alignment slots (48) match the locations of the other threaded studs. The compression plate (42) conforms precisely to the curve of the outer shell (22). This is most easily achieved by cutting the part from an unused portion of the same water heater tank used to make the heating unit (10).

Setting-Up the flexible container

In operation, the flexible tarp (40) is first attached to the heating unit (10). This is most easily accomplished by first, laying the compression plate (42) on the ground in front of the cutout (36) with the alignment slots (48) pointed down. Then, the tarp (40) is laid out with the desired edge of attachment covering the compression plate (42). Next, temporarily attach the tarp's edge to each of the threaded studs (44) by punching small holes in the edge and pushing it onto each of the studs, while turning down the edge so that the tarp's upper surface goes against the outer shell (22). Now, lift the compression plate (42) up, without disturbing the temporary attachment, until the alignment hole (46) can be placed onto it's matching stud, and the other studs are started into their respective alignment slots (48). Finally, using conventional threaded nuts (not shown), and starting with the center alignment hole, tighten the compression plate's studs until the tarp's edge is firmly sandwiched between the outer shell (22), and the inside surface of the compression plate (42). The flexible tarp (40) can now be rolled up and packed inside the heating unit (10) and transported to the desired location for use.

Preferably, the location will include a trough shaped depression. which may be used to hold up the edges of the tarp, forming a bathtub shape. Other possibilities include piling loose material such as sand, rocks, or fallen logs into a suitable shape, or a small portable fence could be used if desired. Water contained in the water space (24) keeps the tarp connection cool, so there is no danger of burning or melting of the tarp. It is important however, that the tarp be protected from contacting the back of the cylindrical firebox (26), by either burying the firebox portion, or piling dirt between it and the tarp. This is particularly important when a wood fire is used, as considerably more heat is generated with wood than is generated with a gas burner.

Summary, Ramifications, and Scope

From the foregoing specification it will be apparent that my heated flexible bathing container is very low cost, efficient, and durable, it benefits the waste disposal system too, by re-using discarded water heaters, and in a way that will give them a longer second life, because of being made repairable.

Although the description above contains many specificities, these should not be construed as limiting the scope of the invention, but as merely providing illustrations of some of the presently preferred embodiments of this invention. For example, the size and shape of the bathtub, as well as the number of heating units used can be varied to accommodate any number of users, without departing from the spirit of the invention. It is also anticipated, that the waterproof connection between the bathtub and heating unit may be accomplished by means such as welding, or other clamping means, along with waterproof seals, or sealing compounds. I am aware that a large variety of "add-ons" are available, for use in hot-tubs, such as circulating pumps, water filters, and heat exchange or recovery systems, that might be beneficially applied to the invention. Also, additional stovepipe sections might be added above the water line to better carry off smoke or fumes that might irritate the user. Furthermore, I recognize that special circumstances, such as when the intended users are young children, or persons unable to sense heat normally, guards or shields may be required to prevent contact with hot surfaces, both above and below the water; including, for example, a series of small water passages between the bathtub and heating units instead of the open passage shown in the drawings. Although the expense or lack of portability of such devices might conflict with the stated objects of the invention, they are still clearly within the scope of it.

I am aware that bathtubs have been constructed with furnaces arranged at one end, and with flues running through the tub so that the products of combustion could pass through and heat the water contained in the tub; I do not wish to be understood as claiming, broadly, such construction.

Thus the scope of the invention should be determined by the appended claims and their legal equivalents, rather than by the examples given.

Having described my invention, what I claim is:

1. A heated bathing container comprising, in combination, a water heating unit having an inner cylindrical chimney and a surrounding outer shell, with a water space in between; a means of supplying heat adjacently below said water space; a flexible tarp removably attached to said water heating unit via a clamping means.

2. The heated bathing container of claim 1 wherein said clamping means comprises, and flexible tarp sandwiched between a compression plate, interiorly shaped to mate with exterior shape of the outer shell.

3. The heated bathing container of claim 1 wherein said means of supplying heat comprises a gas burner.

4. A heated flexible bathing container comprising, in combination, a water heating unit having an inner cylindrical chimney and a surrounding outer shell, with an open top water space in between; a means of supplying heat adjacently below said water space; a flexible tarp removably attached to said water heating unit via a clamping means.

5. The heated bathing container of claim 4 wherein said clamping means comprises, said flexible tarp sandwiched between a compression plate, interiorly shaped to mate with exterior shape of the outer shell.

6. The heated bathing container of claim 4 wherein said means of supplying heat comprises a gas burner.

7. A heated bathing container comprising, in combination, a water heating unit having an inner cylindrical chimney and a surrounding outer shell with an open top water space in between; a means of supplying heat, enclosed within a cylindrical compartment, adjacently below said open top water space; the compartment having a means of accessing interiorly; together with; a flexible tarp elevated relative to said cylindrical compartment, interiorly annexed to said water space via an open water passage, and removably attached to the outer shell via a clamping means; whereby the tarp serves to hold bath water.

8. The bathing container of claim 7 wherein said clamping means comprises, said flexible tarp sandwiched between a compression plate, interiorly shaped to mate with exterior shape of the outer shell.

9. The heated bathing container of claim 7 wherein said means of supplying heat comprises a gas burner.

* * * * *